US011982164B2

(12) United States Patent
Alrabaei et al.

(10) Patent No.: US 11,982,164 B2
(45) Date of Patent: May 14, 2024

(54) ARTIFICIAL LIFT SYSTEMS USING CAVITATION

(71) Applicant: SAUDI ARABIAN OIL COMPANY, Dhahran (SA)

(72) Inventors: Rayan A. Alrabaei, Jeddah (SA); Musa Alnafisah, Shaybah (SA); Mohammed H. Alkhaldi, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/822,984

(22) Filed: Aug. 29, 2022

(65) Prior Publication Data

US 2024/0068337 A1 Feb. 29, 2024

(51) Int. Cl.
*E21B 43/12* (2006.01)

(52) U.S. Cl.
CPC ..... *E21B 43/128* (2013.01)

(58) Field of Classification Search
CPC .... E21B 43/128; E21B 43/121; E21B 43/122; E21B 43/123; E21B 43/1235; E21B 43/124; E21B 43/126; E21B 43/127; E21B 43/129; E21B 43/13
See application file for complete search history.

(56) References Cited

U.S. PATENT DOCUMENTS 4,645,518 A * 2/1987 Roffelsen ..... F02M 37/20 96/195
5,335,730 A * 8/1994 Cotham, III ..... E21B 34/16 166/374
7,338,551 B2 3/2008 Kozyuk
7,762,715 B2 7/2010 Gordon et al.
9,303,216 B2 4/2016 Kozyuk et al.
10,731,441 B2 * 8/2020 Xiao ..... E21B 37/00
2004/0177968 A1 9/2004 Ramachandran
2007/0215346 A1 * 9/2007 Sloan ..... E21B 43/34 166/267
2010/0000738 A1 * 1/2010 Tutuncu ..... E21B 21/103 166/173
2010/0329893 A1 * 12/2010 Martinez ..... F04D 13/08 417/53
2011/0042101 A1 * 2/2011 Sheth ..... F04D 29/044 285/317
2017/0241218 A1 * 8/2017 McKie ..... F22B 1/22
2018/0163517 A1 * 6/2018 Xiao ..... F04D 29/708
2018/0313196 A1 * 11/2018 Frantz, III ..... F04B 47/06
2019/0390538 A1 * 12/2019 Frantz, III ..... E21B 33/12
(Continued)

FOREIGN PATENT DOCUMENTS

WO 2009016756 A1 2/2009

*Primary Examiner* — David Carroll
(74) *Attorney, Agent, or Firm* — Vorys, Sater, Seymour and Pease, LLP

(57) ABSTRACT

A well system that includes a wellbore extending from a surface location and through one or more hydrocarbon bearing subterranean formations, the wellbore containing a downhole fluid, an artificial lift system arranged within the wellbore and in fluid communication with the downhole fluid, the artificial lift system including a cavitation apparatus having one or more blades. The cavitation apparatus is configured to mechanically rotate the one or more blades through the downhole fluid and thereby cause cavitation in the downhole fluid.

14 Claims, 2 Drawing Sheets

(56) References Cited

U.S. PATENT DOCUMENTS

| | | | | |
|---|---|---|---|---|
| 2020/0362683 | A1* | 11/2020 | El Mahbes | E21B 43/38 |
| 2021/0164475 | A1* | 6/2021 | Webster | E21B 43/128 |
| 2021/0171825 | A1* | 6/2021 | May | C09K 8/68 |
| 2022/0010665 | A1* | 1/2022 | Gou | E21B 28/00 |
| 2022/0049695 | A1* | 2/2022 | Romer | E21B 43/128 |

* cited by examiner

ARTIFICIAL LIFT SYSTEMS USING CAVITATION

FIELD OF THE DISCLOSURE

The present disclosure relates generally to the production of hydrocarbons in the oil and gas industry and, more particularly, to the incorporation of an artificial lift system that utilizes cavitation as a technique to assist or sustain hydrocarbon production.

BACKGROUND OF THE DISCLOSURE

In the oil and gas industry, one of the most common techniques to revive a "dead" well and potentially sustain hydrocarbon (e.g., oil) production is through the introduction of artificial gas lift. In a conventional artificial gas lift operation, a high-pressure gas (e.g., nitrogen) is injected into the wellbore (e.g., the production tubing) to reduce the hydrostatic pressure and density of the fluids present within the wellbore, which reduces the bottomhole pressure, and thus allows reservoir liquids to enter the wellbore at a higher flow rate. This also has the effect of "lifting" the well fluids within the wellbore and toward the surface of the well for production.

Artificial gas lift operations are commonly associated with high operational costs, and are oftentimes only temporary and require the use of downhole electric submersible pumps to sustain hydrocarbon production. It is desirable to find and implement new and less costly artificial lift techniques designed to revive dead wells and help sustain oil production.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, A well system may include a wellbore extending from a surface location and through one or more hydrocarbon bearing subterranean formations, the wellbore containing a downhole fluid, and an artificial lift system arranged within the wellbore and in fluid communication with the downhole fluid, the artificial lift system including a cavitation apparatus having one or more blades. The cavitation apparatus may be configured to mechanically rotate the one or more blades through the downhole fluid and thereby cause cavitation in the downhole fluids.

According to another embodiment consistent with the present disclosure, A method includes the steps of arranging an artificial lift system within a wellbore and in fluid communication with a downhole fluid present within the wellbore, wherein the artificial lift system includes a cavitation apparatus having one or more blades, operating the cavitation apparatus and thereby mechanically rotating the one or more blades through the downhole fluid, and causing cavitation in the downhole fluid as the one or more blades rotate through the downhole fluid.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
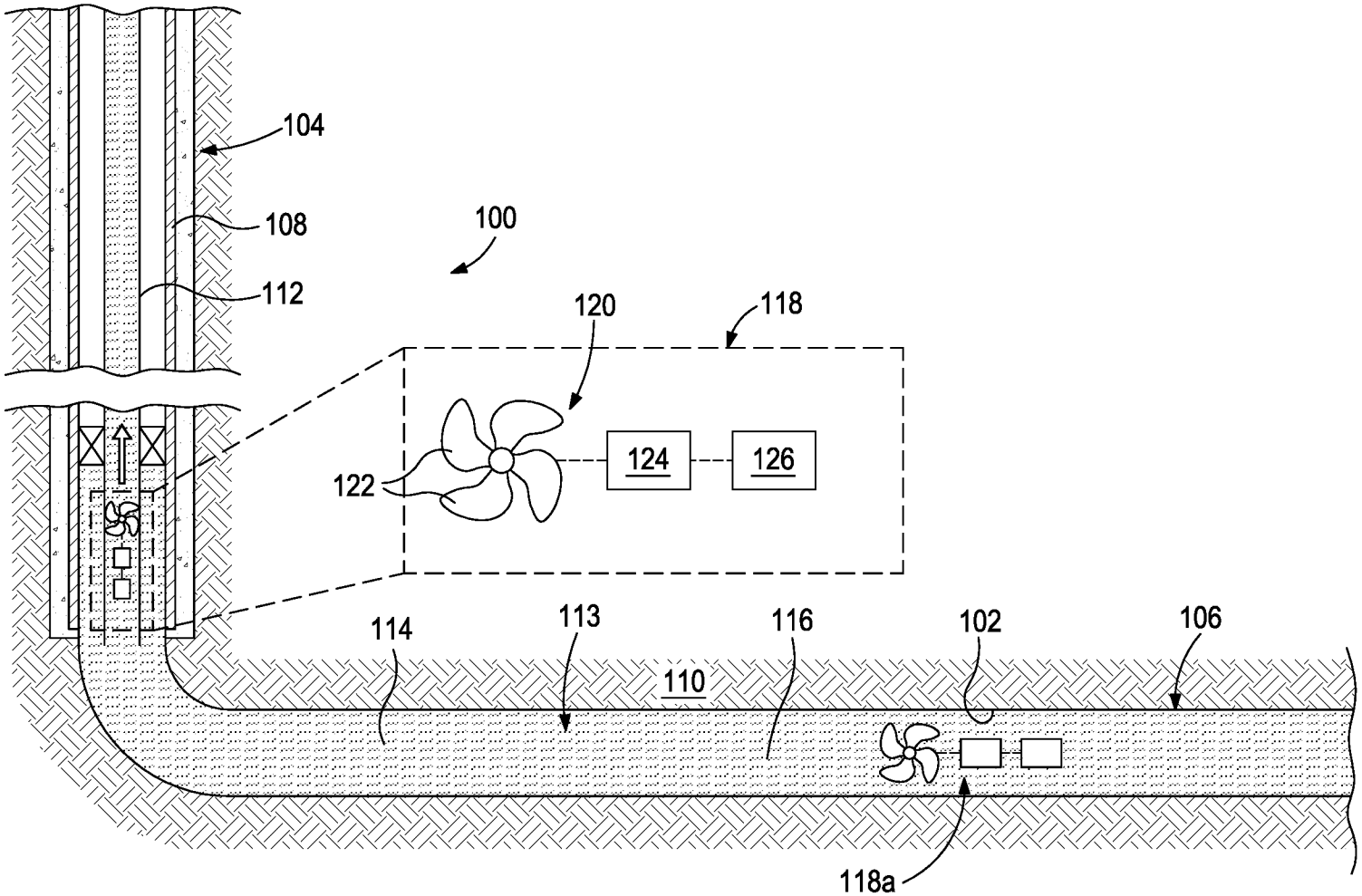
FIG. 1 is an example well system that may employ the principles of the present disclosure, according to one or more embodiments.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

FIG. 1 is a well system 100 that may employ the principles of the present disclosure, according to one or more embodiments. As depicted, the well system 100 includes a wellbore 102 that extends through various earth strata and has a substantially vertical section that transitions into a substantially horizontal section 106. Upper portions of the vertical section 104 may have a string of casing 108 (alternately referred to as "liner") cemented therein, and the horizontal section 106 may extend through a hydrocarbon bearing subterranean formation 110. In some applications, the horizontal section 106 may comprise an open hole section of the wellbore 102. In other embodiments, however, the casing 108 may extend into the horizontal section 106.

A string of pipe 112 may be positioned within the wellbore 102 and arranged concentric with the casing 108. The string of pipe 112 may comprise a string of multiple pipes coupled end-to-end and extended into the wellbore 102. In some embodiments, the string of pipe 112 may comprise a second string of casing anchored to and extending from the first string of casing 108 at an uphole location (not shown). In other embodiments, however, the string of pipe 112 may comprise production tubing arranged within the wellbore 102 and extending from a well surface or wellhead (not shown). In such embodiments, the string of pipe 112 could comprise a continuous length of tubing, such as coiled tubing or the like. Various hydrocarbon extraction systems may be arranged at the wellhead, such as a production rig, a production platform, or the like.

Portions of the wellbore 102 may contain or be filled with one or more downhole fluids 113, such as a mixture or combination of hydrocarbons 114 (e.g., oil, gas, etc.) and water 116 (e.g., brine, fresh water, etc.), that have migrated into the wellbore 102 from the surrounding subterranean formation 110. In some applications, the wellbore 102 may be considered as part of a "dead" well in which the downhole fluids 113 present within the wellbore 102 are unable to flow to the wellhead on their own through natural gas lift or by reservoir pressure. To be able to produce (convey) these fluids 113 to the wellhead (or well surface location), an artificial lift system can be introduced or implemented downhole to propel or "artificially lift" the fluids 113 to the wellhead for extraction.

One type of artificial lift system is known as artificial gas-lift, which usually involves injecting nitrogen downhole to decrease the average liquid column gradient of the fluids present within the wellbore. The resulting pressure drive will be sufficient to initiate and sustain well production. Implementation of conventional artificial gas-lift techniques, however, can require high operational costs and is often only temporary with high water cut percentage (WC %). Moreover, oil production using conventional artificial gas-lift techniques oftentimes cannot be sustained without using downhole electric submersible pumps.

According to embodiments of the present disclosure, the well system 100 may include an artificial lift system 118 that utilizes cavitation and, more particularly, hydrodynamic cavitation, as a technique to assist or sustain hydrocarbon production. Cavitation is the process of vaporization, bubble generation, and bubble implosion which occurs in a flowing liquid as a result of a decrease and subsequent rapid increase in local pressure. More particularly, cavitation occurs when the local pressure of a liquid declines to a point below the saturated vapor pressure of the liquid followed by subsequent recovery above the vapor pressure. In some applications, hydrodynamic cavitation can be produced by mechanical rotation of an object (e.g., a propeller) through the liquid. Based on Bernoulli's principle, a local increase in flow velocity of the fluid can lead to a static pressure drop to the critical point at which cavitation can be initiated. The critical pressure point is the vapor saturated pressure of the fluid.

The phenomenon is named "cavitation" because small vapor-filled cavities (alternately referred to as "bubbles" or "voids") form when the fluid pressure has been reduced to its vapor saturated pressure. These vapor-filled cavities expand as they move, but suddenly collapse (i.e., implode) upon entering a region of higher pressure (e.g., lower velocity). The violent collapse can cause tremendous localized increases in pressure and temperature and intense shearing forces. Cavitation can be more dramatic in viscous fluids, such as oil. If, for example, oil moves at a high speed causing its pressure to drop below the vapor pressure of some hydrocarbon constituents present within the oil, cavitation will occur. The cavitation can separate the liquid-phase, high-boiling-point compounds and their particles suspended in liquid compounds from the entrapped gases, water vapor and vapors of the affected compounds.

The artificial lift system 118 may be introduced downhole and secured (anchored) within the wellbore 102 for operation. Alternatively, the artificial lift system 118 may form part of a downhole completion, such as being used in conjunction with a production tubular at different well depths. The artificial lift system 118 may be positioned at a location that places the artificial lift system 118 in fluid communication with the downhole fluids 113. For example, the artificial lift system 118 may be arranged in the wellbore 102 at a location where it is submerged within the downhole fluids 113. In the illustrated embodiment, the artificial lift system 118 is arranged within the string of pipe 112 and secured at or near the downhole end thereof. In other embodiments, however, the artificial lift system 118 may alternatively be arranged within an open-hole portion of the wellbore 102, shown in FIG. 1 as artificial lift system **118*a*, or within the first string of casing 108, without departing from the scope of the disclosure. As will be appreciated, the artificial lift system 118, 118*a*** can be installed downhole at any depth.

As depicted in the enlarged image of FIG. 1, the artificial lift system 118 includes a cavitation apparatus 120. In the illustrated embodiment, the cavitation apparatus comprises a propeller or fan that includes one or more of blades 122 equidistantly spaced from each other. While four blades 122 are shown in the enlarged image of FIG. 1, more or less than four blades 122 may be included in the propeller or fan, without departing from the scope of the disclosure. As the cavitation apparatus 120 mechanically rotates, the blades 122 cut through the downhole fluids 113 and create a suction force that draws the downhole fluids towards the cavitation apparatus 120 and subsequently towards the wellhead (i.e., uphole). Accordingly, the cavitation apparatus 120 can operate as a type of downhole pump capable of pumping or driving the downhole fluids 113 uphole and towards the wellhead. It should be noted that while only one propeller or fan is shown in the enlarged image of FIG. 1, in some embodiments, the cavitation apparatus 120 may include multiple (several) propellers or fans, and the number of blades 122 in each propeller or fan may be the same or different.

Moreover, the cavitation apparatus 120 may be operated at a speed (i.e., rotations per minute or "RPM") fast enough to generate cavitation in the downhole fluids 113. More specifically, the cavitation apparatus 120 may be operated at a speed that results in a localized increase of fluid velocity, especially at the tips of the blades 122. At these localized increased fluid velocities, the static pressure of the downhole fluids 113 will drop to the vapor saturated pressure at which point cavitation will ensue. The gases released from the downhole fluids 113 may, at least temporarily, lower the overall produced fluid gradient (i.e., density) of the downhole fluids 113, which may help propel the downhole fluids 113 toward the wellhead and facilitate hydrocarbon production. Generating cavitation in the downhole fluids 113 can introduce gases (at least temporarily) into the oil column of the downhole fluids 113, which can serve as a back pressure on the reservoir. Once this occurs, the backpressure on the oil column will be less, thus enabling the reservoir to lift the oil column within the wellbore 102 and help the well produce. Moreover, violent mixing or agitation of the hydrocarbons 114 and the water 116 in the downhole fluids 113 can result in homogenization of the downhole fluids 113, which can also help decrease the overall fluid density of the downhole fluids 113, thus promoting more efficient uphole movement of the downhole fluids 113.

The cavitation apparatus 120 and, more particularly, the blades 122, can exhibit a diameter of varying sizes to fit within various parts of the wellbore 102. In embodiments where the cavitation apparatus 120 is arranged within the string of pipe 112, for example, the diameter of the blades 122 may be slightly smaller than the inside diameter of the string of pipe 112. In embodiments where the cavitation apparatus 120 is arranged within the open-hole section of the wellbore 102, however, the diameter of the blades 122 may be slightly smaller than the inside diameter of the wellbore 102. In other embodiments, however, the blades 122 may exhibit any diameter that allows the cavitation apparatus 120 to be accommodated in any portion of the wellbore 102. Incorporating a cavitation apparatus 120 with different sizes for the blades 122 could increase control over fluid velocity and thus control differential pressure, which may allow for more sustained production and well revival.

In some embodiments, as illustrated, the cavitation apparatus 120 may be concentrically arranged within the wellbore 102. In other embodiments, however, the cavitation apparatus 120 may be eccentric to a centerline of the wellbore 102, without departing from the scope of the disclosure.

The artificial lift system 118 may also include a motor 124 operatively coupled to the cavitation apparatus 120 and operable to cause the cavitation apparatus 120 to operate. The motor 124 may comprise any type of motor capable of operating in the downhole environment and delivering the required power to operate the cavitation apparatus 120 at the desired speed, and thus generate cavitation within the downhole fluids 113.

The artificial lift system 118 may further include a power source 126 used to provide electrical power to operate the motor 124. In some embodiments, the power source may comprise a thermoelectric converter, also known as a thermoelectric generator. Due to the thermoelectric effect, a semiconductor within the thermoelectric generator converts a temperature difference into current, which can be used to power the motor 124. In other embodiments, however, the power source 126 may comprise a variety of other sources of electrical power including, but not limited to, one or more batteries, a fuel cell, or any combination thereof.

Figure 2:
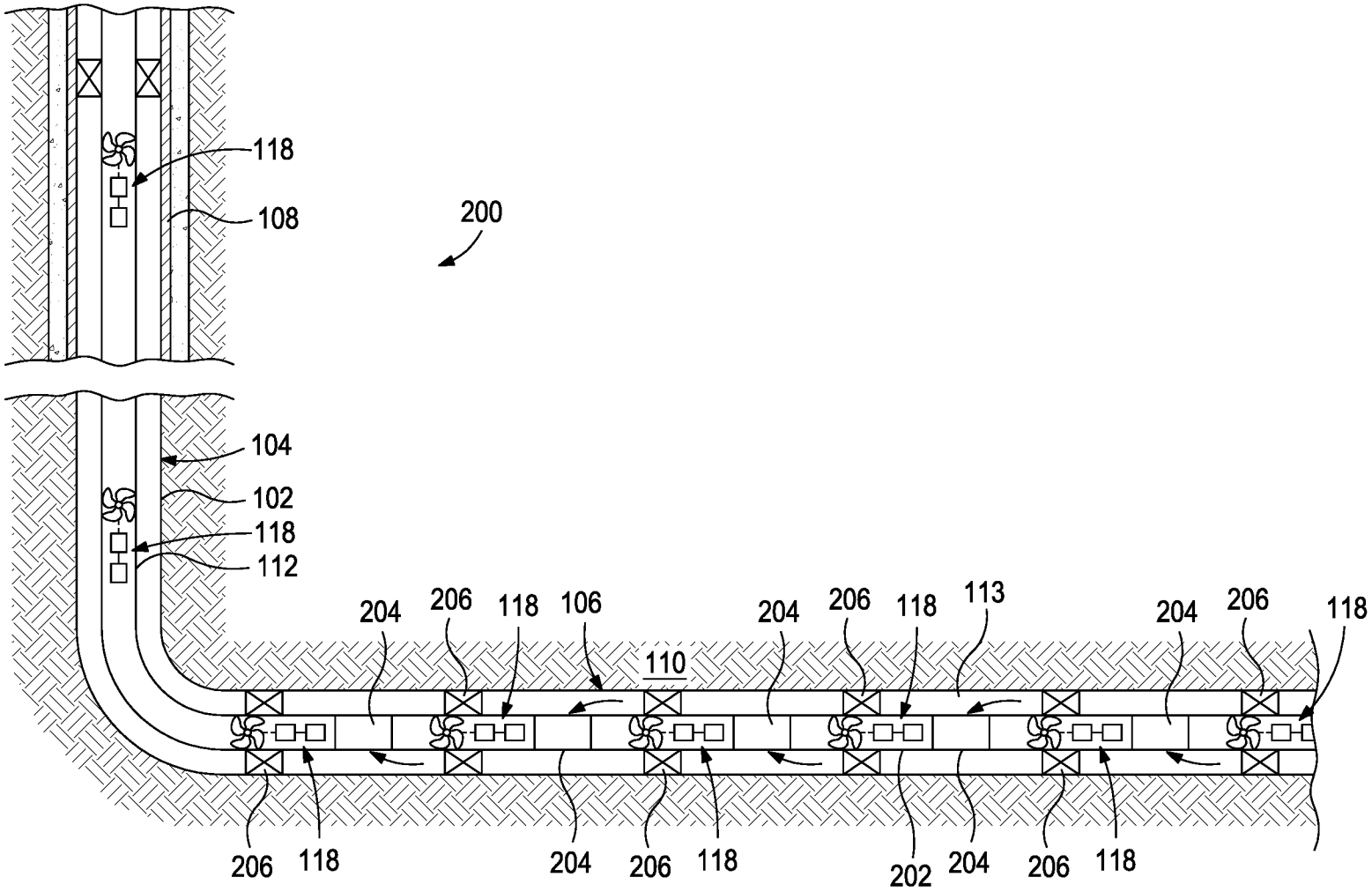
FIG. 2 is another example well system that may employ the principles of the present disclosure, according to one or more additional embodiments.

FIG. 2 is another example well system 200 that may employ the principles of the present disclosure, according to one or more embodiments. The well system 200 may be similar in some respects to the well system 100, and therefore, may be best understood with reference thereto, where like numerals will refer to like components that may not be described again. As illustrated the well system 200 includes the wellbore 102 with the vertical section that transitions to the horizontal section 106 and penetrates the subterranean formation 110. At least a portion of the vertical section 104 may be lined with the casing 108, and the string of pipe 112 may be extended into the wellbore 102 within the casing 108.

In the illustrated embodiment, the string of pipe 112 comprises production tubing and the lower (downhole) end of the string of pipe 112 may be coupled to and otherwise form part of a downhole completion 202 arranged within the horizontal section 106. The downhole completion 202 serves to divide the wellbore 102 into various production intervals (alternately referred to as "pay zones") adjacent the formation 110. During production operations, the string of pipe 112 provides a conduit for fluids extracted from the surrounding formation 110 to travel to the wellhead.

As depicted, the downhole completion 202 may include a plurality of flow control assemblies 204 axially offset from each other along portions of the downhole completion 202. In some applications, each flow control assembly 204 may be positioned between a pair of packers 206 that provides a fluid seal between the downhole completion 202 and the wellbore 102, and thereby defining corresponding production intervals along the length of the downhole completion 202. Each flow control assembly 204 may operate to selectively regulate fluid flow into the string of pipe 112 from the surrounding formation 110. The flow control assemblies 204 may include, for example, a screen assembly, one or more inflow control devices, or any combination thereof.

It should be noted that even though FIG. 2 depicts the flow control assemblies as being arranged in an open hole portion of the wellbore 102, one or more of the flow control assemblies 204 could alternatively be arranged within cased portions of the wellbore 102. Also, even though FIG. 2 depicts the flow control assemblies 204 as being arranged in the horizontal section 106 of the wellbore 102, the flow control assemblies 204 could alternatively be arranged in the vertical section 104 or any section therebetween.

The system 200 may further include a plurality of artificial lift systems 118 arranged in series within the wellbore 102. More specifically, one or more artificial lift systems may be arranged within the vertical portion 104 of the wellbore, and an additional one or more artificial lift systems 118 may be arranged within the horizontal portion 106 of the wellbore 102. The cavitation apparatus 120 (FIG. 1) of each artificial lift system 118 may be configured to mechanically rotate and cut through the downhole fluids 113 present within the wellbore 102, and thereby generate a suction force that draws the downhole fluids 113 into the string of pipe 112 and uphole within the string of pipe 112. The artificial lift systems 118 located adjacent the flow control assemblies 204 may be configured to draw in the downhole fluids 113 through the flow control assemblies 204.

Each artificial lift system 118 may also be configured to generate cavitation in the downhole fluids 113 to assist or sustain hydrocarbon production, as generally described above. More specifically, the cavitation apparatus 120 (FIG. 1) of each artificial lift system may be configured to increase the velocity while simultaneously decreasing the pressure of the downhole fluids 113 to a point where cavitation of the downhole fluids 113 occurs, as described herein. The gases released from the downhole fluids 113 may, at least temporarily, lower the overall produced fluid gradient (i.e., density) of the downhole fluids 113, which may help propel the downhole fluids 113 toward the wellhead and facilitate hydrocarbon production. Moreover, violent mixing or agitation of the downhole fluids 113 can homogenize and help decrease the overall fluid density of the downhole fluids 113, which promotes more efficient uphole movement of the downhole fluids 113.

Embodiments disclosed herein include:

A. A well system includes a wellbore extending from a surface location and through one or more hydrocarbon bearing subterranean formations, the wellbore containing a downhole fluid, and an artificial lift system arranged within the wellbore and in fluid communication with the downhole fluid, the artificial lift system including a cavitation apparatus having one or more blades. The cavitation apparatus is configured to mechanically rotate the one or more blades through the downhole fluid and thereby cause cavitation in the downhole fluids.

B. A method includes the steps of arranging an artificial lift system within a wellbore and in fluid communication with a downhole fluid present within the wellbore, wherein the artificial lift system includes a cavitation apparatus having one or more blades, operating the cavitation apparatus and thereby mechanically rotating the one or more blades through the downhole fluid, and causing cavitation in the downhole fluid as the one or more blades rotate through the downhole fluid.

Each of embodiments A and B may have one or more of the following additional elements in any combination: Element 1: wherein mechanically rotating the one or more blades creates a suction force that drives the downhole fluid uphole and towards the surface location. Element 2: wherein the artificial lift system is arranged within an open-hole portion of the wellbore. Element 3: further comprising a string of pipe arranged within the wellbore, wherein the artificial lift system is secured within the string of pipe. Element 4: wherein the string of pipe is selected from the group consisting of casing, liner, production tubing, and a downhole completion. Element 5: wherein the artificial lift system comprises a plurality of artificial lift systems arranged in series within the wellbore. Element 6: wherein the downhole fluid includes hydrocarbons and water, and wherein causing cavitation in the downhole fluid further causes homogenization of the hydrocarbons and water. Element 7: further comprising production tubing extended within the wellbore, and a downhole completion coupled to and extending from the production tubing, wherein the artificial lift system comprises a plurality of artificial lift systems arranged in series within the downhole completion and the production tubing. Element 8: wherein the artificial lift system further includes a motor operatively coupled to the cavitation apparatus and operable to cause the cavitation apparatus to operate, and a power source that provides electrical power to the motor. Element 9: wherein the power source is selected from the group consisting of a thermoelectric converter, one or more batteries, a fuel cell, and any combination thereof.

Element 10: further comprising creating a suction force on the downhole fluid as the one or more blades mechanically rotate through the downhole fluid, and driving the downhole fluid uphole and towards a surface location of the wellbore using the suction force. Element 11: wherein the downhole fluid includes hydrocarbons and water, the method further comprising causing homogenization of the hydrocarbons and water as the one or more blades mechanically rotate through the downhole fluid. Element 12: wherein the artificial lift system includes a plurality of artificial lift systems, and wherein arranging the artificial lift system within the wellbore comprises arranging the plurality of artificial lift systems in series within the wellbore. Element 13: wherein the artificial lift system further includes a motor operatively coupled to the cavitation apparatus and operable to cause the cavitation apparatus to operate, the method further comprising providing electrical power to the motor with a thermoelectric converter.

By way of non-limiting example, exemplary combinations applicable to A and B include: Element 3 with Element 4; and Element 8 with Element 9.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, as used herein, the terms "coupled" or "coupled to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A well system, comprising:

a wellbore extending from a surface location and through one or more hydrocarbon bearing subterranean formations, the wellbore containing a downhole fluid;

an artificial lift system arranged within the wellbore and in fluid communication with the downhole fluid, the artificial lift system including a cavitation apparatus having one or more blades, wherein the cavitation apparatus is configured to mechanically rotate the one or more of blades through the downhole fluid and thereby cause cavitation in the downhole fluids; and a thermoelectric converter within the downhole fluid and coupled to the cavitation apparatus.

2. The well system of claim 1, wherein the thermoelectric converter is arranged downhole of the cavitation apparatus within the downhole fluid.

3. The well system of claim 1, wherein the artificial lift system is arranged within an open-hole portion of the wellbore.

4. The well system of claim 1, further comprising a string of pipe arranged within the wellbore, wherein the artificial lift system is secured within the string of pipe.

5. The well system of claim 4, wherein the string of pipe is selected from the group consisting of casing, liner, and production tubing.

6. The well system of claim 1, wherein the artificial lift system comprises a plurality of artificial lift systems arranged in series within the wellbore.

7. The well system of claim 1, wherein the downhole fluid includes hydrocarbons and water, and wherein causing cavitation in the downhole fluid further causes homogenization of the hydrocarbons and water.

8. The well system of claim 1, further comprising production tubing extended within the wellbore, wherein the artificial lift system comprises a plurality of artificial lift systems arranged in series within the production tubing.

9. The well system of claim 1, wherein the artificial lift system further includes:

a motor operatively coupled to the cavitation apparatus and operable to cause the cavitation apparatus to operate, wherein the thermoelectric converter provides electrical power to the motor.

10. A method, comprising:

arranging an artificial lift system within a wellbore and in fluid communication with a downhole fluid present within the wellbore, wherein the artificial lift system includes a cavitation apparatus having one or more blades and a thermoelectric converter arranged within the downhole fluid;

operating the cavitation apparatus and thereby mechanically rotating the one or more blades through the downhole fluid; and causing cavitation in the downhole fluid to thereby induce a temperature difference in the downhole fluid as the one or more blades rotate through the downhole fluid; and converting the temperature difference into electrical power with the thermoelectric converter within the downhole fluid.

11. The method of claim 10, further comprising:

creating a suction force on the downhole fluid as the one or more blades mechanically rotate through the downhole fluid; and driving the downhole fluid uphole and towards a surface location of the wellbore using the suction force.

12. The method of claim 10, wherein the downhole fluid includes hydrocarbons and water, the method further comprising causing homogenization of the hydrocarbons and water as the one or more blades mechanically rotate through the downhole fluid.

13. The method of claim 10, wherein the artificial lift system includes a plurality of artificial lift systems, and wherein arranging the artificial lift system within the wellbore comprises arranging the plurality of artificial lift systems in series within the wellbore.

14. The method of claim 10, wherein the artificial lift system further includes a motor operatively coupled to the cavitation apparatus and operable to cause the cavitation apparatus to operate, the method further comprising providing electrical power to the motor with the thermoelectric converter.

* * * * *